US009353696B2

(12) United States Patent
Midlam-Mohler et al.

(10) Patent No.: US 9,353,696 B2
(45) Date of Patent: May 31, 2016

(54) COMBUSTION CONTROLLER FOR INTERNAL COMBUSTION ENGINE

(75) Inventors: Shawn Midlam-Mohler, Columbus, OH (US); Jason Meyer, Novi, MI (US); Stephen Yurkovich, Plano, TX (US); Vivek Sujan, Columbus, IN (US)

(73) Assignee: Cummins IP, Inc., Minneapolis, MN (US)

( * ) Notice: Subject to any disclaimer, the term of this patent is extended or adjusted under 35 U.S.C. 154(b) by 563 days.

(21) Appl. No.: 13/479,568

(22) Filed: May 24, 2012

(65) Prior Publication Data

US 2013/0317722 A1 Nov. 28, 2013

(51) Int. Cl.

| | |
|---|---|
| ***F02D 41/30*** | (2006.01) |
| ***F02D 41/14*** | (2006.01) |
| ***F02D 41/18*** | (2006.01) |
| *F02D 41/02* | (2006.01) |
| *F02D 41/00* | (2006.01) |

(52) U.S. Cl.

CPC ..... *F02D 41/30* (2013.01); *F02D 41/1401* (2013.01); *F02D 41/1447* (2013.01); *F02D 41/18* (2013.01); *F02D 41/0002* (2013.01); *F02D 41/027* (2013.01); *F02D 2041/1412* (2013.01)

(58) Field of Classification Search

CPC ... F02D 35/02; F02D 35/0092; F02D 41/182; F02D 41/2406; F02D 41/2409; F02D 41/2422; F02D 41/30; F02D 43/04

USPC ..... 701/103, 104, 109, 115; 123/344, 402, 123/435, 672, 676, 704, 472, 478, 480, 486, 123/492

See application file for complete search history.

(56) References Cited

U.S. PATENT DOCUMENTS

| | | | | |
|---|---|---|---|---|
| 4,924,837 | A * | 5/1990 | Chujo et al. | 123/494 |
| 5,597,951 | A | 1/1997 | Yoshizaki et al. | |
| 5,974,870 | A | 11/1999 | Treinies et al. | |
| 6,155,242 | A | 12/2000 | Kotwicki et al. | |
| 6,738,707 | B2 | 5/2004 | Kotwicki et al. | |
| 7,174,713 | B2 | 2/2007 | Nitzke et al. | |
| 7,318,342 | B2 | 1/2008 | Boehm et al. | |
| 2004/0103647 | A1 * | 6/2004 | Yomogida et al. | 60/284 |
| 2006/0011180 | A1 * | 1/2006 | Sasaki et al. | 123/698 |
| 2007/0174003 | A1 * | 7/2007 | Ueno et al. | 701/104 |
| 2008/0046128 | A1 * | 2/2008 | Sasaki et al. | 700/274 |
| 2008/0072878 | A1 * | 3/2008 | Kokubu | 123/486 |

OTHER PUBLICATIONS

L. Guzzella et al., Control of Diesel Engines, IEEE Control Systems, 0272-1708, Oct. 1998.

(Continued)

*Primary Examiner* — Erick Solis
*Assistant Examiner* — Anthony L Bacon
(74) *Attorney, Agent, or Firm* — Foley & Lardner LLP

(57) ABSTRACT

According to one embodiment, an apparatus for controlling combustion in an internal combustion engine having a fuel delivery system includes a cylinder contents prediction module configured to predict at least one condition within a combustion cylinder of the internal combustion engine. The apparatus also includes a fueling parameter selection module configured to generate a fuel command for the fuel delivery system. The fuel command is based at least partially on the predicted at least one condition within the combustion cylinder.

15 Claims, 4 Drawing Sheets

(56) References Cited

OTHER PUBLICATIONS

D. Memering et al., Comparison of Adaptive Control Techniques Applied to Diesel Engine Idle Speed Regulation, Journal of Dynamic Systems, Measurement, and Control, vol. 124, pp. 682-709, Dec. 2002.

Y. Li et al., Fuel-Injection Control System Design and Experiments of a Diesel Engine, IEEE Transactions on Control Systems Technology, vol. 11, No. 4, pp. 565-570, Jul. 2003.

J. Jiang, Optimal Gain Scheduling Controller for a Diesel Engine, IEEE Control Systems, 0272-1708, pp. 42-48, Aug. 1994.

P. Langthaler et al., Robust Model Predictive Control of a Diesel Engine Airpath, Proceedings of the 17th World Congress, The International Federation of Automatic Control, Seoul, Korea, Jul. 6-11, 2008, pp. 4388-4393.

P. Langthaler et al., Fast Predictive Oxygen Charge Control of a Diesel Engine, Proceedings of the 2007 American Control Conference, New York City, USA, Jul. 11-13, 2007.

M. Jankovic et al., Constructive Lyapunov Control Design for Turbocharges Diesel Engines, IEEE Transactions on Control Systems Technology, vol. 8 No. 2, pp. 288-299, Mar. 2000.

M. Jung et al., Calibratable Linear Parameter-Varying Control of a Turbocharged Diesel Engine, IEEE Transactions on Control Systems Technology, vol. 14 No. 1, pp. 45-62, Jan. 2006.

S. Chen et al., Transient NOx Emissions Reduction Using Exhaust Oxygen Concentration Based Control for a Diesel Engine, SAE International, 2005-01-0372, 2005.

M. Ammann et al., Model-Based Control of the VGT and EGR in a Turbocharged Common-Rail Diesel Engine: Theory and Passenger Car Implementation, SAE International, 2003-01-0357, 2003.

A. Amstutz et al., EGO Sensor Based Robust Output Control of EGR in Diesel Engines, IEEE Transactions on Control Systems Technology, vol. 3 No. 1, pp. 39-48, Mar. 1995.

E. Alfieri et al., Gain-Scheduled Model-Based Feedback Control of the Air/Fuel Ratio in Diesel Engines, Control Engineering Practice 17, pp. 1417-1425, Published by Elsevier Ltd., 2008.

M.J. Van Nieuwstadt et al., Coordinated EGR-VGT Control for Diesel Engines: An Experimental Comparison, SAE International, 2000-01-0266, 2000.

* cited by examiner

COMBUSTION CONTROLLER FOR INTERNAL COMBUSTION ENGINE

FIELD

This disclosure relates to internal combustion engines, and more particularly to controlling the combustion characteristics of an internal combustion engine.

BACKGROUND

Control systems for controlling combustion events in an internal combustion engine system are known in the art. Conventional control systems are designed to control the contents within an engine's combustion cylinders or chambers (e.g., air) and the injected fuel to provide a desired trade-off between performance, noise, fuel economy, and emissions. As shown in FIG. 1, a conventional internal combustion engine system 10 includes an internal combustion engine 20 and an electronic control unit 30 for controlling operation of the engine and the various sub-systems of the engine system. The engine system 10 also includes an air path system 40 and a fuel delivery system 50 each coupled to the engine 20. The air path system 40 is operable to supply air and recycled exhaust gas to the engine's combustion cylinders. The fuel system 50 is operable to supply fuel to the engine's combustion cylinders. The fuel in the combustion cylinders is combusted in the presence of the air and recycled exhaust gas to generate the energy necessary for powering the engine. The amount of power produced by the engine 10 is primarily controlled by input from a driver 60 in the form of a torque request via the accelerator pedal of the vehicle.

The torque request is communicated to the ECU 30, which processes the torque request, and issues air actuator commands and fueling commands responsive to the torque request. The air path system 40 is actuated to add air and residual gas to the engine 20 in accordance with the air actuator commands, and the fuel system 50 adds fuel to the engine in accordance with the fueling commands. The ECU 30 includes various modules configured to determine air actuator commands and fueling commands that satisfy the torque request in view of the above-discussed trade-offs and other factors. As shown, the ECU 30 includes a supervisory controller 32 that determines and communicates a current or desired engine control state to a system properties control module 34 of the ECU. Based on the torque request from the driver 60, the engine control state, and the speed of the engine, the system properties control module 34 issues air path targets and fueling commands. The air path targets are transmitted to and received by an air path controller 36, which issues the air actuator commands to achieve the air path targets in view of performance feedback from the air path system 40. The fueling commands are transmitted to and received by the fuel system 50, which is actuated to deliver fuel to the engine to achieve the fueling amount commanded by the fueling commands.

Although the engine system 10 provides several benefits, the system also suffers from several shortcomings. The system properties control module 34 of the system 10 utilizes a feed-forward approach to separately determining the air path requests and fueling commands. Accordingly, once the air path requests and fueling commands are issued by the module 34, neither the air path requests or fueling commands are modified in response to the actual conditions realized by the fuel delivery and air delivery systems, respectively, except under abnormal operating conditions, such as reducing fuel mass to reduce particulate matter emissions. This leads to a number of undesirable behaviors. Decoupling the air path requests and fueling commands in this manner leaves the system open to reduced performance due to inherent delays in the system. Such decoupling also does not account for changes in the engine or power plant behavior over time when attempting to realize the fuel commands and air request. Additionally, prior art control representations do not properly, accurately, or efficiently account for different modes of operation resulting from various conditions, such altitude or exhaust thermal management. To account for these conditions, some systems includes a large number of two-dimensional feed-forward air path and fueling maps each accounting for one or more off-nominal considerations. Further, some systems rely solely on air path systems to attempt to correct variability and inconsistencies through a feedback mechanism of the air path system without adjusting the fueling parameters in any way.

While utilizing a large number of two-dimensional feed-forward maps may accommodate many off-nominal considerations (e.g., engine control states), the use of multiple maps cannot adequately account for all of the off-nominal considerations or conditions encountered during operation of an engine. Moreover, the more maps required for operation of an engine, the more complex the tuning and calibration process for obtaining the proper values that populate the maps. Additionally, the more maps required for operation, the more complex the control structure and hardware requirements, and the higher the burden on the engine system's ECU.

Another potential setback with conventional engine systems for controlling combustion events is the disparity in response times between the air path system and the fuel delivery system. Especially during transient operating conditions, the response time of the air path system may lag that of the fuel delivery system. However, conventional engine systems do not adequately take into account the different response times of the air path system and fuel delivery system. In other words, with conventional engine systems, the setpoints or targets for the air path system and fuel delivery system are typically set at the same time with a feed-forward approach, but the fuel delivery system setpoints are not adjusted for subsequent delays in the response time of the air path system. These fuel commands may be adjusted in an ad hoc fashion, however, it is not done in a unified way.

SUMMARY

The subject matter of the present application has been developed in response to the present state of the art, and in particular, in response to the problems and needs in the combustion control system art that have not yet been fully solved by currently available combustion control systems. Accordingly, the subject matter of the present application has been developed to provide an apparatus, system, and method for controlling combustion events in an internal combustion engine that overcomes many of the shortcomings of the prior art. For example, in some embodiments, as opposed to prior art systems, which control the fueling of the engine independently of the instantaneous cylinder conditions, the combustion control system disclosed herein controls the fueling of the engine based on the instantaneous cylinder conditions. Accordingly, in addition to a feedback mechanism within the air path system, the fueling strategy of the combustion control system disclosed herein also dynamically accounts for the variability and inconsistencies often associated with the operation of the engine over time, such as poorly performing components of the air path system and delays in the response times of the components of the air path system. Generally, because the fueling control of the present disclosure is based on the instantaneous cylinder conditions, fewer fuel maps and calibrations (e.g., lower calibration margins) are required to achieve the same or similar performance and emissions as prior art systems using many more calibration maps.

According to one embodiment, an apparatus for controlling combustion in an internal combustion engine having a fuel delivery system includes a cylinder contents prediction module configured to predict at least one condition within a combustion cylinder of the internal combustion engine. The apparatus also includes a fueling parameter selection module configured to generate a fuel command for the fuel delivery system. The fuel command is based at least partially on the predicted at least one condition within the combustion cylinder.

In some implementations of the apparatus, the fueling parameter selection module further includes a fuel table module that is configured to determine at least one nominal fueling parameter based at least partially on the predicted at least one condition within the combustion cylinder and to determine at least one peak fueling parameter based at least partially on the predicted at least one condition within the combustion cylinder. The fuel command is based on a weighted combination of the at least one nominal fueling parameter and the at least one peak fueling parameter. In one implementation, the fueling parameter selection module includes a weight factor module that is configured to determine a temperature weight factor based on a desired exhaust temperature, a nominal exhaust temperature, and a peak exhaust temperature. The weighted combination can be weighted according to the determined weight factor.

According to some implementations of the apparatus, the internal combustion engine includes an air path system. The apparatus can further include a system properties control module that is configured to determine at least one air path performance target based on a specific speed and torque of the engine. The system properties control module may be further configured to determine a total fuel mass to be added to the engine based on the specific speed and torque of the engine. The fuel command can be based at least partially on the determined total fuel mass. In some implementations, the fueling parameter selection module includes a fuel table module that includes at least one nominal fueling table and at least one peak fueling table. The at least one nominal fueling table includes predetermined nominal fueling parameter values compared against a combination of three engine operating condition values. The at least one peak fueling table includes predetermined peak fueling parameter values compared against the same combination of three engine operating condition values. The fuel table module determines at least one nominal fueling parameter value from the at least one nominal fueling table based on current values for the three engine operating conditions and determines at least one peak fueling parameter value from the at least one peak fueling table based on current values for the three engine operating conditions. The fuel command is based on at least one of the determined nominal and peak fueling parameter values. The three engine operating conditions can be the predicted at least one condition within the combustion cylinder, the total fueling mass, and the engine speed. The predicted at least one condition within the combustion cylinder, in some instances, can be a predicted oxygen concentration within the combustion cylinder.

In certain implementations, the apparatus further includes a fuel state module that is configured to determine a fuel control state of the internal combustion engine based on an engine control state of the internal combustion engine. The fuel command can be based at least partially on the determined fuel control state. In one implementation, the fuel control state is limited to one of a nominal fuel control state and a temperature management fuel control state. The engine control state can be one of more than two possible engine control states.

According to some implementations of the apparatus, the fuel command is based on fueling parameter values obtained from a set of look-up tables associated with a fuel control state of the engine. The fuel control state is selected from only two possible fuel control states and the set of look-up tables consists of one set of look-up tables associated with a first of the two possible fuel control states and another set of look-up tables associated with a second of the two possible fuel control states.

According to yet some implementations of the apparatus, the internal combustion engine includes an air path system, and the apparatus further includes a system properties control module that is configured to determine at least one air path performance target based on a specific speed and torque of the engine. Additionally, the fuel command is based at least partially on the specific speed and torque of the engine. Moreover, the predicted at least one condition within the combustion cylinder includes a prediction of at least one condition within the combustion cylinder resulting from a combustion event governed by the at least one air path performance target. In certain implementations, the internal combustion engine includes an air path system, and the predicted at least one condition within the combustion cylinder is based on a prediction of the actual performance of the air path system.

According to another embodiment, a method for controlling combustion in an internal combustion engine includes determining air path targets based on operating conditions of the internal combustion engine. The method also includes commanding an air path system of the internal combustion engine based on the determined air path targets. Further, the method includes determining fuel parameters based on the operating conditions of the internal combustion engine and a prediction of the actual performance of the air path system when actuated according to the determined air path targets. The method additionally includes commanding a fuel delivery system of the internal combustion engine based on the determined fuel parameters.

In some implementations of the method, the prediction of the actual performance of the air path system includes a prediction of at least one condition within a combustion cylinder of the internal combustion engine. In yet some implementations of the method, determining the fuel parameters comprises weighting nominal fuel parameters obtained from a nominal fuel look-up table and peak fuel parameters obtained from a peak fuel look-up table. The nominal fuel parameters and peak fuel parameters can be weighted according to a comparison between a desired exhaust temperature, a nominal exhaust temperature, and a peak exhaust temperature.

According to certain implementations of the method, the air path targets are determined based on one of a plurality of air path table sets each associated with a plurality of engine control states. The fuel parameters are determined based on at least one of only two fuel parameter table sets each associated with one of only two fuel control states. The two fuel control states can be condensed representations of the plurality of engine control states.

In yet another embodiment, an internal combustion engine system includes an internal combustion engine with combustion cylinders. The engine system also includes an air path system that is coupled to the internal combustion engine. The air path system is configured to supply air to the combustion cylinders according to air path commands. The engine system further includes a fuel delivery system that is coupled to the internal combustion engine. The fuel delivery system is configured to supply fuel to the combustion cylinders according to fueling commands. Additionally, the engine system includes a controller that is communicable in electronic communication with the air path system and fuel delivery system. The controller includes a system properties control module that is configured to determine air path targets based on operating conditions of the internal combustion engine. The air path commands are based on the determined air path targets. The controller also includes a fueling parameter selection module that is configured to determine fueling parameters based on the air path targets. The fueling commands are based on the determined fueling parameters.

The described features, structures, advantages, and/or characteristics of the subject matter of the present disclosure may be combined in any suitable manner in one or more embodiments and/or implementations. In the following description, numerous specific details are provided to impart a thorough understanding of embodiments of the subject matter of the present disclosure. One skilled in the relevant art will recognize that the subject matter of the present disclosure may be practiced without one or more of the specific features, details, components, materials, and/or methods of a particular embodiment or implementation. In other instances, additional features and advantages may be recognized in certain embodiments and/or implementations that may not be present in all embodiments or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

BRIEF DESCRIPTION OF THE DRAWINGS

In order that the advantages of the subject matter may be more readily understood, a more particular description of the subject matter briefly described above will be rendered by reference to specific embodiments that are illustrated in the appended drawings. Understanding that these drawings depict only typical embodiments of the subject matter and are not therefore to be considered to be limiting of its scope, the subject matter will be described and explained with additional specificity and detail through the use of the drawings, in which.

DETAILED DESCRIPTION

Reference throughout this specification to "one embodiment," "an embodiment," or similar language means that a particular feature, structure, or characteristic described in connection with the embodiment is included in at least one embodiment of the present disclosure. Appearances of the phrases "in one embodiment," "in an embodiment," and similar language throughout this specification may, but do not necessarily, all refer to the same embodiment. Similarly, the use of the term "implementation" means an implementation having a particular feature, structure, or characteristic described in connection with one or more embodiments of the present disclosure, however, absent an express correlation to indicate otherwise, an implementation may be associated with one or more embodiments.

Figure 1:
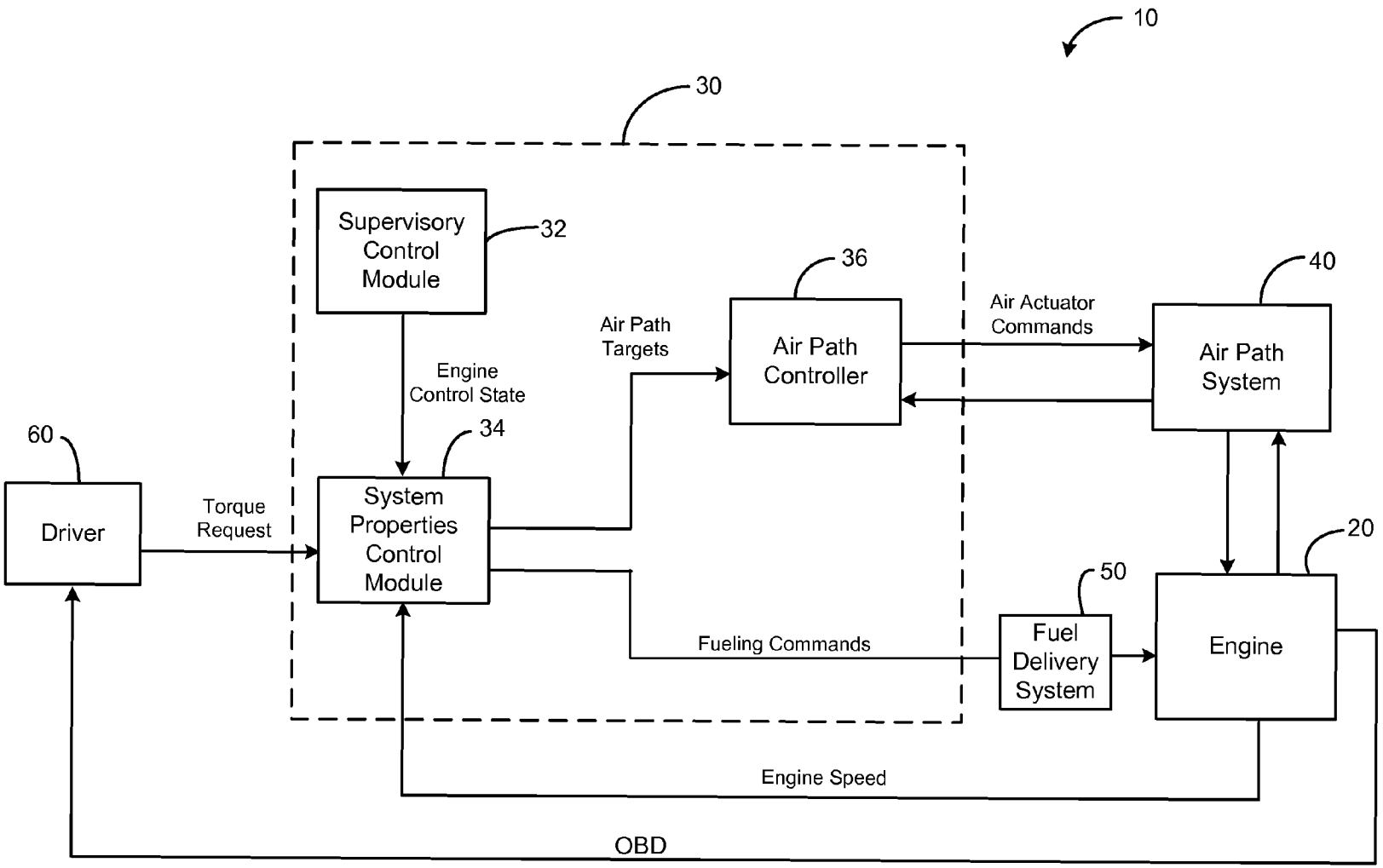
Fig. 1 (prior art)
FIG. 1 is a schematic block diagram of an internal combustion engine system having an engine, electronic control unit, air path system, and fuel delivery system according to the prior art.
Figure 2:
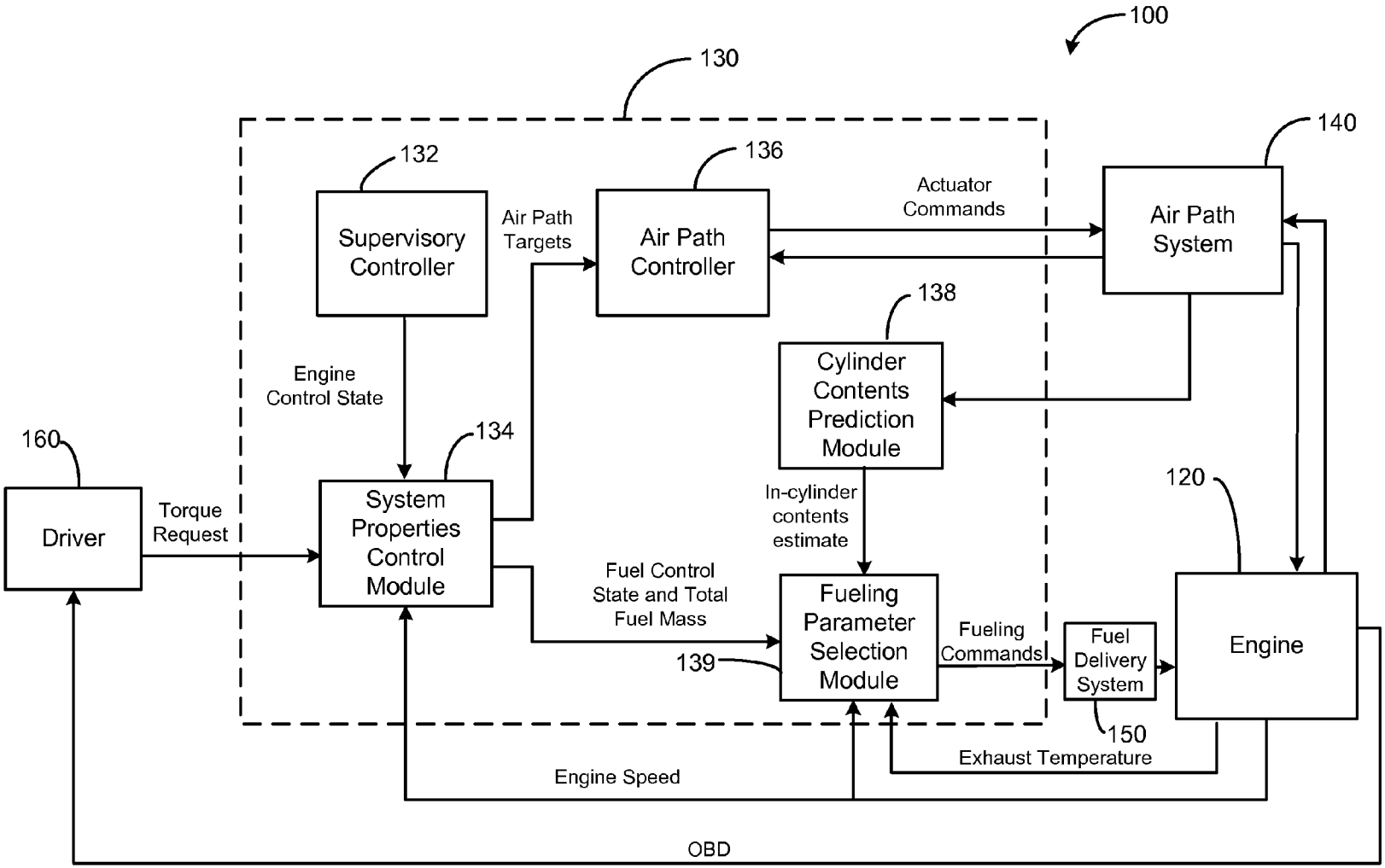
FIG. 2 is a schematic block diagram of an internal combustion engine system having an engine, electronic control unit, air path system, and fuel delivery system according to one embodiment of the present disclosure.

According to one embodiment depicted in FIG. 2, an internal combustion engine system 100 includes an internal combustion engine 120 and an electronic control unit (ECU) or controller 130 for controlling operation of the engine and various sub-systems of the engine system. The ECU 130 communicates with and/or receives communication from various components of the system 100, including the engine, an accelerator pedal, on-board diagnostics, various sensors, and the like. In some implementations, the ECU 130 also communicates with other sensors and actuators according to the hardware of the specific configuration of the system 100. The controller 130 is depicted in FIG. 1 as a single physical unit, but can include two or more physically separated units or components in some embodiments if desired. In certain embodiments, the ECU 130 receives multiple inputs, processes the inputs, and transmits multiple outputs. The multiple inputs may include sensed measurements from the sensors, estimated inputs, and various user inputs. The inputs are processed by the ECU 130 using various algorithms, stored data, and other inputs to update the stored data and/or generate output values. The generated output values and/or commands are transmitted to other components of the ECU and/or to one or more elements of the engine system 100 to control the system to achieve desired results, and more specifically, achieve desired fuel consumption, performance, and emissions-reduction characteristics.

Like conventional combustion engine systems, the internal combustion engine system 100 includes an air path system 140 and a fuel delivery system 150 respectively coupled in air and fuel providing communication to the engine. More specifically, the air path system 140 is operable to supply air and recycled exhaust to combustion cylinders (not shown) of the engine 120 and the fuel system 150 is operable to supply fuel to the combustion cylinders of the engine. The supplied fuel in the combustion cylinders is combusted in the presence of the supplied air and recycled exhaust gas to generate the energy necessary for powering the engine 150. The energy generated by a combustion event within a combustion cylinder is dependent upon, among other factors, the amount of fuel in the combustion cylinder. Generally, the higher the amount of fuel in the combustion cylinder, the higher the energy generated by the combustion event. To improve fuel economy, the relative proportions of air, recycled exhaust, fuel mass, and fuel injection parameters in the cylinder are carefully selected to improve the efficiency of the combustion event.

Figure 3:
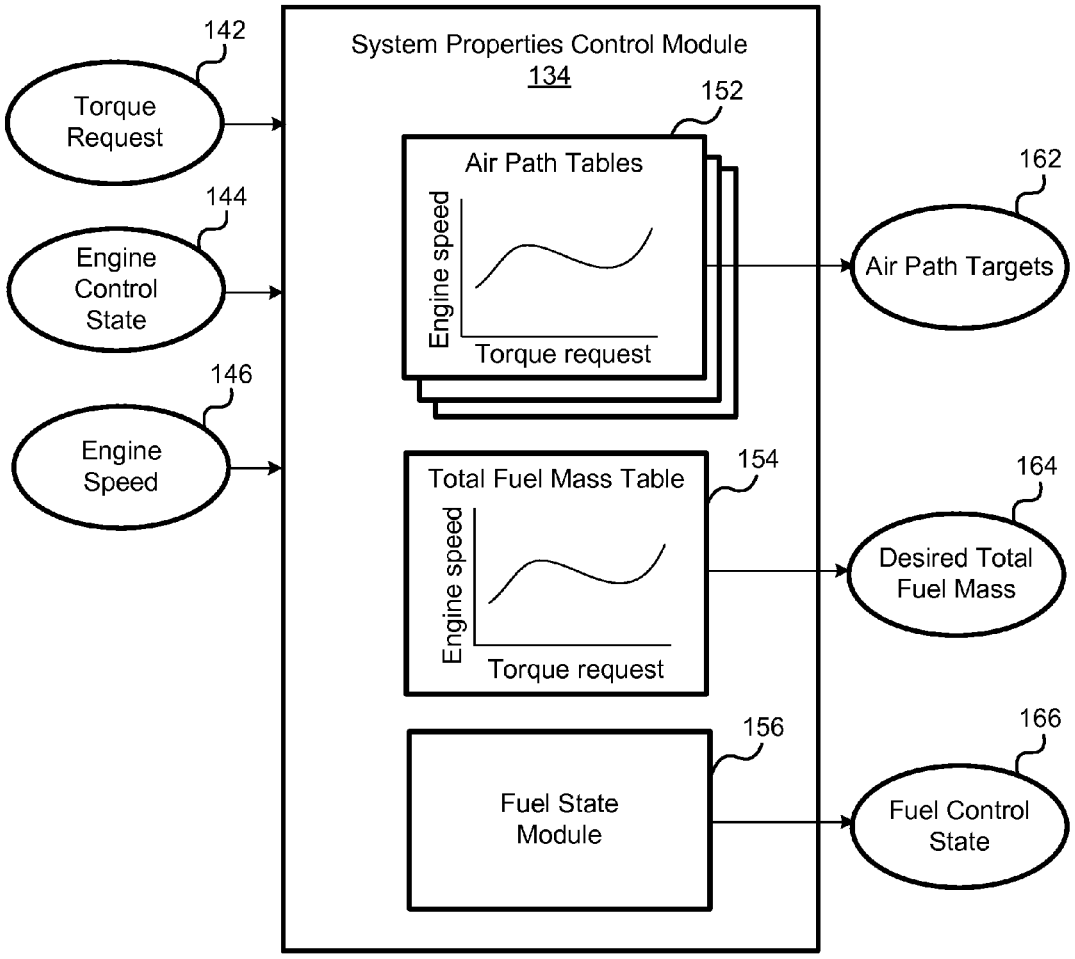
FIG. 3 is a schematic block diagram of a system properties control module 134 of an electronic control unit according to one embodiment of the present disclosure.

In automotive applications, the amount of power (e.g., torque) produced by the engine 120 is primarily controlled by input from a driver 160 in the form of a torque request (see, e.g., torque request 142 of FIG. 3). The amount of torque requested is based on the position of a driver-actuated accelerator pedal (not shown), which is associated with a desired speed or acceleration load on an engine. For example, in some implementations, the ECU 130 of the engine system 100 receives a position of the accelerator and generates a torque request based at least partially on the accelerator position. The torque request may also be based on other considerations, such as, for example, sub-system loads (e.g., air conditioning loads, electrical power loads, transmission loads, etc.). Generally, the torque request represents the amount of torque or power required by the engine to meet the various loads placed on the engine. The engine system 100 can include an on-board diagnostics (OBD) feedback look to inform the driver 160 of the performance and general operational characteristics of the engine 120.

The ECU 130 includes a supervisory control module 132 and system properties control module 134. The supervisory control module 132 determines a control state 144 of the engine 120 and communicates the determined control state to the system properties control module 134 (see, e.g., FIG. 3). The engine control state 144 can be any of a plurality of possible control states associated with operation of a particularly configured or rated engine system. For example, in one embodiment, the engine can be operated any one of a number of control states, such as, for example, steady-state, transient, high altitude, low altitude, exhaust aftertreatment component regeneration, high performance, fuel economy, cold start, component protection/failure, AFR-limiting, and the like.

After receiving the engine control state 144 from the supervisory control module 132, the system properties control module 134 determines air path targets 162, a desired total fuel mass 164, and a fueling control state 166. The air path targets 162 (e.g., air path performance targets) represent the desired performance of the air path system 140, which directly corresponds with the properties (e.g., flow rate, pressure, temperature, mass concentration) of the intake air entering the combustion cylinders. Generally, the air path targets 162 are determined from one of a plurality of air path look-up tables or maps 152 each associated with one of a plurality of possible engine control states. Each air path table 152 includes predetermined air path target values corresponding with possible engine speed and torque request values. The system properties control module 134 generates the air path targets 162 by selecting the air path table 152 associated with the received engine control state 144, and determining the air path target values corresponding with the received torque request 142 and engine speed 146. The generated air path targets 162 are transmitted to the air path controller 136, which issues actuator commands for commanding one or more actuators of the air path system 140. For example, in one implementation, the air path targets 162 may include a variable geometry turbocharger (VGT) vane position for achieving a desired rate of fresh air flow, an exhaust gas recirculation (EGR) valve position for adding a desired amount of exhaust gas to the intake air volume, and an intake throttle position for achieving a desired intake manifold pressure. The air path controller 136 then issues and transmits commands to the VGT, EGR valve, and intake throttle to actuate into a position for achieving the desired air path system properties.

The system properties control module 134 determines the desired total fuel mass 164 representing the total amount of fuel mass to be added to the combustion cylinders over a specific time interval for a given engine speed and torque request. Generally, the desired total fuel mass 164 is determined from a look-up table or map 154 storing predetermined total fuel mass values corresponding with any of various operating conditions, such as possible engine speed and torque request values. In one implementation, the system properties control module 134 determines the desired total fuel mass 164 by selecting the total fuel mass value corresponding with the received torque request 142 and engine speed 146. The desired total fuel mass 164 is transmitted to a fueling parameter selection module 139 that is configured to issue fueling commands to the fuel system 150 of the system 100 as will be explained in more detail below. Basically, the fueling commands represent how the desired total fuel mass 164 should be split between different injection pulses and the timing of each pulse.

The fueling control state 166 is determined by a fueling state module 156 of the system properties control module 134. As will be described in more detail below with reference to the fueling parameter selection module 139, the fueling control state 166 determines which fuel look-up table is used for selecting the fueling commands for the fuel delivery system 150. In contrast to conventional systems, the fuel look-up tables used for selecting the fueling commands do not correspond directly with the plurality (i.e., more than at least two in some implementations) of engine control states. In other words, the present system 100 does not include a separate, and separately calibrated, fuel look-up table for each of the plurality of engine control states. Rather, to reduce calibration complexity, the fuel look-up tables of the present system 100 are limited to the number of fueling control states of the system 100, which can be fewer than the number of engine control states. Basically, in certain implementations, the fueling control states of the system 100 are reorganized and condensed representations of the full range of engine control states.

In the illustrated embodiment, the system 100 is operable under one of only two fueling states: (1) nominal operation; and (2) thermal management operation. Accordingly, the fueling control state 166 passed on to the fueling parameter selection module 139 is one of a nominal operation fuel state or thermal management operation fueling state. Which one of the two fueling states selected by the fueling state module 156 is largely dependent on the engine control state.

Nominal operation is associated with operation of the engine when the temperature of the exhaust gas is not a primary concern. For example, the fueling of the engine is controlled under the nominal operation fueling state when the engine is operating under both steady-state and transient engine control states (e.g., for all ambient temperatures and pressures), AFR-limiting (or smoke-limiting) engine control states, and all component protection/failure engine control states (e.g., turbo surge and choke prevention engine control states).

In contrast, thermal management operation is associated with operation of the engine when the exhaust gas temperature is a primary concern and an exhaust temperature target is issued. Generally, thermal management operation is selected by the fueling state module 156 as the fueling control state 166 when operating conditions of the engine system (e.g., the engine control state) require a specific exhaust temperature or temperature range. For example, during cold starts of the engine (e.g., warm-up engine control states), the operating conditions of the engine system require a higher exhaust gas temperature than would be produced under nominal operation of the engine. Additionally, at times, an exhaust aftertreatment system (not shown) of the engine system 100 may require higher exhaust gas temperatures than would be achieved under normal operation of the engine (e.g., regeneration engine control states). Exhaust aftertreatment systems are configured to reduce harmful emissions in the exhaust gas generated by the engine into less harmful emissions. Often, the components of the exhaust aftertreatment system require a higher exhaust temperature for performing the emission-reducing functions of the system. For example, an exhaust aftertreatment system may include a diesel particulate filter (DPF) that requires higher exhaust temperatures for regenerating (e.g., removing accumulated soot from) the DPF and/or a selective catalytic reduction (SCR) system that requires higher exhaust temperatures for properly reducing a reductant injected into the exhaust.

Figure 4:
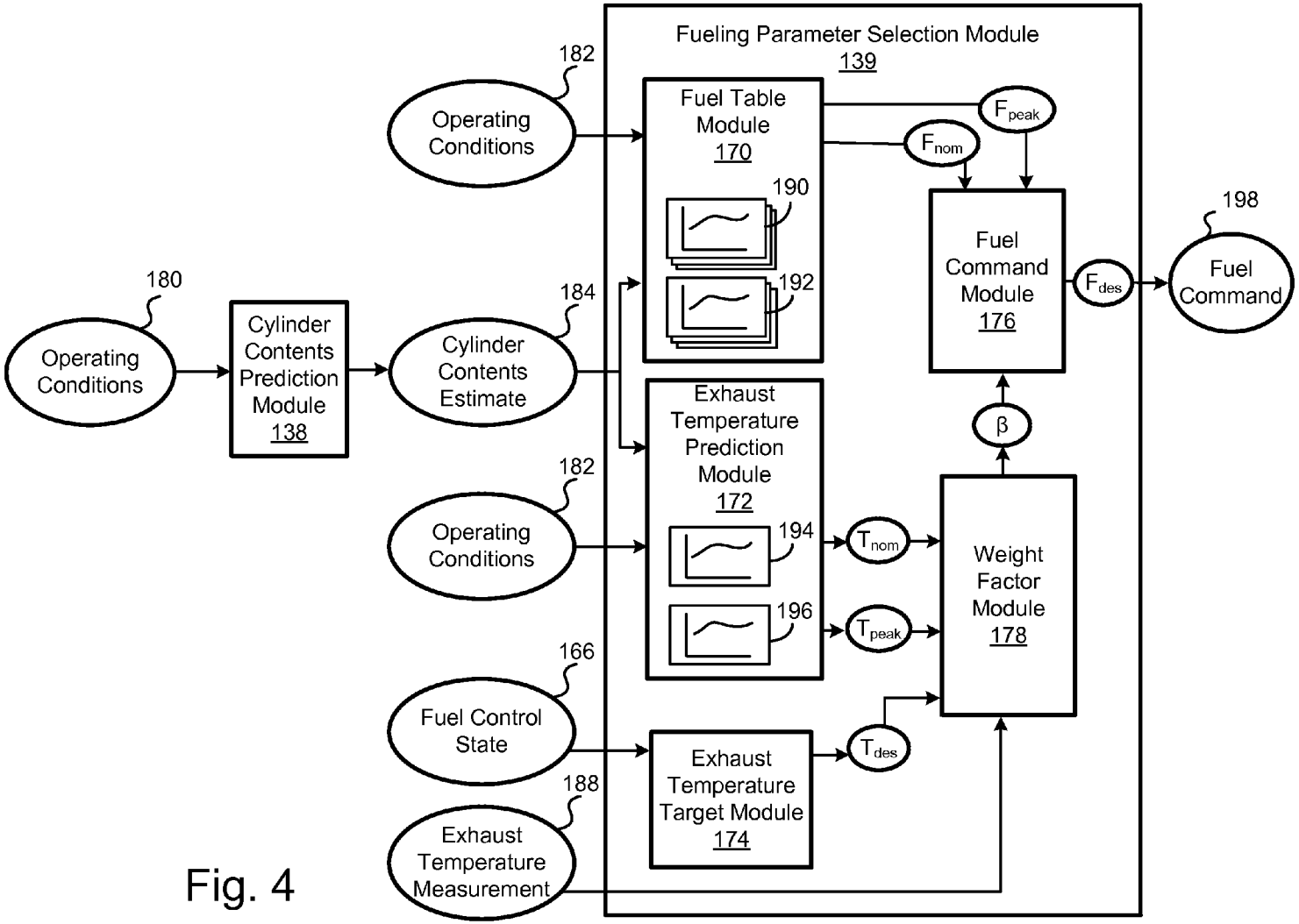
FIG. 4 is a schematic block diagram of a cylinder contents module and fueling parameter selection module of an electronic control unit according to one embodiment of the present disclosure.

Referring back to FIG. 2, the ECU 130 includes a cylinder contents prediction module 138 configured to predict or estimate the instantaneous contents (e.g., conditions) in the combustion cylinders. The cylinder contents prediction module 138 can estimate the instantaneous contents in the combustion chambers according to any of various techniques and approaches. Generally, in one particular implementation, the cylinder contents prediction module 138 predicts the cylinder contents in two steps. First, the module 138 estimates the concentration (e.g., fraction or mass) of trapped residual post-combustion elements in the cylinders using a static and/or dynamic function of the operating conditions of the engine system 100. The estimate of the trapped elements can be based on estimated and/or measured operating conditions 180, such as, but not limited to, intake pressure, exhaust pressure, fresh air mass flow rate, EGR mass flow rate, fuel charge mass flow rate, and engine speed. Second, the module 138 predicts the cylinder contents by predicting the dynamics of the air path system 140 in view of the estimate of the trapped elements concentration. The dynamics of the air path system 140 can be predicted using estimated and/or measured operating conditions 180, such as, but not limited to, intake manifold pressure, fuel charge density, fresh air mass flow rate, EGR mass flow rate, fuel charge mass flow rate, and engine speed. As shown in FIG. 4, in some implementations, the output of the cylinder contents prediction module 138 includes one or more cylinder contents estimates 184, such as estimates of the in-cylinder total trapped fuel charge, trapped burned gas, trapped fresh air, fresh air fraction, oxygen concentration, and trapped fuel charge density. Essentially, the in-cylinder contents estimates 184 are based on a prediction of the actual performance of the air path system 140 actuated according to the actuator commands from the air path controller, which are based on the air path targets. The cylinder contents estimate or estimates 184 is communicated from the cylinder contents prediction module 138 to the fueling parameter selection module 139. It is also possible for the cylinder contents prediction module 138 to generate predictions of cylinder contents for each cylinder individually which allows cylinder-by-cylinder optimization of the combustion event.

Referring to FIG. 4, the fueling parameter selection module 139 includes a fuel table module 170 configured to output nominal fuel parameters or fuel parameter sets $F_{nom}$ and peak fuel parameters or fuel parameter set $F_{peak}$. Essentially, the nominal fuel parameters $F_{nom}$ represent the fuel parameters (e.g., fuel pulse masses (e.g., pilot injection quantity, post injection quantity, etc.) and start of injection (SOI) timing for each fuel pulse (e.g., main SOI, pilot SOI, post SOI)) associated with fueling operation in the nominal fuel control state. Similarly, the peak fuel parameters $F_{peak}$ represent the fuel parameters associated with fueling operation in the thermal management fuel control state. The nominal fuel parameters $F_{nom}$ and peak fuel parameters $F_{peak}$ are obtained from respective sets of nominal and peak fuel look-up tables or maps 190, 192. The nominal fuel look-up tables 190 include multiple tables each associated with a given fuel parameter. Likewise, the peak fuel look-up tables 192 include multiple tables each associated with the same given fuel parameters. The look-up tables 190, 192 each include respective predetermined fuel parameter values corresponding with possible engine operating conditions. Accordingly, each of the respective fuel parameters $F_{nom}$, $F_{peak}$ is obtained from the tables 190, 192 by determining the predetermined fuel parameter value associated with current operating conditions. The determined fuel parameters $F_{nom}$, $F_{peak}$ are transmitted to a fuel command module 176 of the fueling parameter selection module 139, which utilizes the fuel parameters to generate the fuel commands 198 necessary for operating the fuel delivery system 150 of the engine system 100.

The engine operating conditions included in the tables 190, 192 and that govern the determination of the fuel parameters $F_{nom}$, $F_{peak}$ include at least one instantaneous in-cylinder condition estimate 184 obtained from the cylinder contents prediction module 138. Additionally, in certain implementations, the engine operating conditions included in the tables 190, 192 for determining the fuel parameters $F_{nom}$, $F_{peak}$ also include at least one operating condition 182. Generally, in some implementations, the engine operating conditions in the tables 190, 192 include some combination of one or more instantaneous in-cylinder conditions estimates 184 and one or more operating conditions 182. In one specific implementation, each table 190, 192 includes fuel parameter values corresponding to the operating conditions 182 of engine speed and total fuel mass (e.g., desired total fuel mass 164), and an in-cylinder contents estimate 184 of oxygen in the cylinder. Accordingly, in such an implementation, the fuel parameters $F_{nom}$, $F_{peak}$ are based on the indexing combination of current engine speed, total fuel mass, and in-cylinder oxygen concentration. However, in other implementations, the tables 190, 192 are calibrated based on other indexing combinations of in-cylinder parameters and operating conditions. Therefore, the indexing combinations utilized in the tables 190, 192 to determine the fueling parameters can be any of various combinations of in-cylinder parameters and operating conditions based on any of various factors (e.g., engine type, engine rating, engine performance, engine hardware, etc.) as desired.

Generally, the fuel tables 190, 192 each include fuel parameter values for at least three operating conditions. Accordingly, the fuel tables 190, 192 can be defined as three-dimensional tables. Although some prior art systems utilize two-dimensional fuel tables, as discussed above, such prior art systems have a separate fuel table for each fueling parameter at each of the full range of engine control states. In other words, prior art systems require tens and sometimes hundreds of two-dimensional fuel tables for operation. In contrast, the present system 100 facilitates the use of a significantly reduced number of three-dimensional fuel tables for operation (e.g., one fuel table for each fueling parameter but at only two fuel control states).

As discussed above, in view of the inherent inconsistencies and variabilities of the components of the air path system 140, such as, for example, transport delays, and filling and emptying dynamics, the desired air path targets cannot be instantly achieved. Moreover, such inconsistencies and variabilities of the air path system directly can negatively affect the cylinder contents and combustion performance. Because the fuel parameters governing operation of the fueling system 150 are at least partially based on the instantaneous in-cylinder conditions, the system 100 is able to select the fueling parameters that produce a desirable combustion regardless of the performance, or lack of performance as the case may be, of the air path system 140. In other words, the system 100 of the present disclosure the air and fueling parameters can be set in a more efficient, sequential process compared to prior art systems that set the air and fueling parameters at the same time.

Additionally, because the objectives of operating in the nominal fuel control state and thermal management state differ, the predetermined fuel parameter values of the respective tables 190, 192 at the same operating conditions also differ. For example, the predetermined fuel parameter values $F_{nom}$ for operation in the nominal fuel control state are calibrated to achieve an optimal trade-off between engine exhaust emissions and fuel consumption for given operating conditions. In contrast, the predetermined fuel parameter values $F_{peak}$ for operation in the thermal management fuel control state are calibrated to achieve higher (e.g., the highest in some implementations) engine-out combustion gas temperatures, sometimes at the expense fuel consumption.

The fueling parameter selection module 139 includes an exhaust temperature prediction module 172 configured to output a nominal exhaust temperature $T_{nom}$ and a peak (e.g., maximum) exhaust temperature $T_{peak}$. Generally, the nominal exhaust temperature $T_{nom}$ represents the exhaust gas temperature predicted to result from operation of the engine using the nominal fuel parameters $F_{nom}$, and the peak exhaust temperature $T_{peak}$ represents the exhaust gas temperature predicted to result from operation of the engine using the peak fuel parameters $F_{peak}$. The nominal exhaust temperature and peak exhaust temperature $T_{peak}$ are obtained from respective nominal and peak exhaust temperature look-up tables 194, 196. The look-up tables 194, 192 each include respective predetermined temperature values corresponding with the same engine operating condition indexing combination used for the fuel look-up tables 190, 192.

The fueling parameter selection module 139 also includes an exhaust temperature target module 174 configured to output a desired exhaust temperature $T_{des}$ based on the fuel control state 166 of the system. Generally, the desired exhaust temperature $T_{des}$ represents the exhaust temperature necessary for accommodating the operational needs of the engine system 100. For example, if the fuel control state 166 is a thermal management state and a sub-system (e.g., exhaust aftertreatment system) of the engine system 100 requires an specific elevated exhaust temperature to properly operate the sub-system (e.g., to regenerate a DPF), the temperature target module 174 will output a desired exhaust temperature $T_{des}$ equal to the specific elevated exhaust temperature. If, however, the fuel control state 166 is a nominal state and the engine system 100 does not require a specific elevated exhaust temperature for operation, the desired exhaust temperature $T_{des}$ will be set to a nominal exhaust temperature (e.g., nominal exhaust temperature $T_{nom}$). It can be recognized that the desired exhaust temperature $T_{des}$ can be set to any of various desired temperatures as may be necessary for operation of the engine system.

Referring again to FIG. 4, the fueling parameter selection module 139 includes a weight factor module 178 configured to output a weight factor β. The weight factor β can be determined in any of various manners using any of various techniques. In one particular embodiment, the weight factor module 178 calculates the weight factor β based on the nominal exhaust temperature $T_{nom}$, peak exhaust temperature $T_{peak}$, and desired exhaust temperature $T_{des}$ according to the following equation:

$$\beta = \frac{T_{des} - T_{nom}}{T_{peak} - T_{nom}} \tag{1}$$

Applying Equation 1, the weight factor β is equal to '0' when operating in the nominal fuel control state because the desired exhaust temperature $T_{des}$ is equal to the nominal exhaust temperature $T_{nom}$. When operating in the thermal management fuel control state, the desired exhaust temperature $T_{des}$ is some temperature greater than the nominal exhaust temperature $T_{nom}$ such that the weight factor β is some number greater than '0' and equal to or less than '1'. According to Equation 1, the weight factor β is '1' when the desired exhaust temperature $T_{des}$ is equal to the peak exhaust temperature $T_{peak}$, and the weight factor β is some number between '0' and '1' when the desired exhaust temperature $T_{des}$ is between the nominal exhaust temperature $T_{nom}$ and the peak exhaust temperature $T_{peak}$. Once calculated, the weight factor β is communicated to the fuel command module 176 to be used in the generation of the fuel commands 198.

Generally, the fuel command module 176 compares the weight factor β to the nominal fuel parameters $F_{nom}$ and peak fueling parameters $F_{peak}$ to determine desired fueling parameters $F_{des}$ for commanding the fueling delivery system 150. After the desired fueling parameters $F_{des}$ are determined, the fuel command module 176 generates fuel commands 198 representing commands for actuating the actuators of the fuel system 150 to achieve the desired fueling parameters. Although any of various techniques can be applied to determine the desired fueling parameters $F_{des}$, in one particular embodiment, the desired fueling parameters are determined by application of the following equation:

$$F_{des}=(1-\beta-\alpha)F_{nom}+(\beta+\alpha)F_{peak} \tag{2}$$

where α is a feedback correction factor. The feedback correction factor α is used to correct any errors in the weight factor β in steady-state operating conditions and when a reliable exhaust temperature measurement is available. For example, if the actual exhaust gas temperature as measured is different than the desired exhaust gas temperature $T_{des}$, then the feedback correction factor α is set to either effectively increase or decrease the weight factor β as the case may be such that the desired fueling parameters $F_{des}$ are appropriately adjusted to achieve the desired exhaust gas temperature. If an exhaust temperature measurement is not available or may be unreliable, the feedback correction factor α is set to '0' and no effective adjustment to the weight factor β occurs.

Some of the operating conditions of the system 100 utilized in the fueling control operations described herein can be obtained by one or more sensing devices configured to sense (e.g., detect, measure, estimate, etc.) at least one operating condition and report the sensed operating condition to the ECM 130. In some embodiments, the sensing devices include one or more of mass flow sensors, pressure sensors, temperature sensors, engine speed sensors, vehicle speed sensors, mass concentration sensors, and the like. The sensors can include physical sensors or virtual sensors.

The schematic flow chart, block, and method diagrams described above are generally set forth as logical flow chart diagrams. As such, the depicted order and labeled steps are indicative of representative embodiments. Other steps and methods may be conceived that are equivalent in function, logic, or effect to one or more steps, or portions thereof, of the methods illustrated in the schematic diagrams. Additionally, the format and symbols employed are provided to explain the logical steps of the schematic diagrams and are understood not to limit the scope of the methods illustrated by the diagrams. Although various arrow types and line types may be employed in the schematic diagrams, they are understood not to limit the scope of the corresponding methods. Indeed, some arrows or other connectors may be used to indicate only the logical flow of a method. For instance, an arrow may indicate a waiting or monitoring period of unspecified duration between enumerated steps of a depicted method. Additionally, the order in which a particular method occurs may or may not strictly adhere to the order of the corresponding steps shown.

Many of the functional units described in this specification have been labeled as modules, in order to more particularly emphasize their implementation independence. For example, a module may be implemented as a hardware circuit comprising custom VLSI circuits or gate arrays, off-the-shelf semiconductors such as logic chips, transistors, or other discrete components. A module may also be implemented in programmable hardware devices such as field programmable gate arrays, programmable array logic, programmable logic devices or the like.

Modules may also be implemented in software for execution by various types of processors. An identified module of computer readable program code may, for instance, comprise one or more physical or logical blocks of computer instructions which may, for instance, be organized as an object, procedure, or function. Nevertheless, the executables of an identified module need not be physically located together, but may comprise disparate instructions stored in different locations which, when joined logically together, comprise the module and achieve the stated purpose for the module.

Indeed, a module of computer readable program code may be a single instruction, or many instructions, and may even be distributed over several different code segments, among different programs, and across several memory devices. Similarly, operational data may be identified and illustrated herein within modules, and may be embodied in any suitable form and organized within any suitable type of data structure. The operational data may be collected as a single data set, or may be distributed over different locations including over different storage devices, and may exist, at least partially, merely as electronic signals on a system or network. Where a module or portions of a module are implemented in software, the computer readable program code may be stored and/or propagated on in one or more computer readable medium(s).

The computer readable medium may be a tangible computer readable storage medium storing the computer readable program code. The computer readable storage medium may be, for example, but not limited to, an electronic, magnetic, optical, electromagnetic, infrared, holographic, micromechanical, or semiconductor system, apparatus, or device, or any suitable combination of the foregoing.

More specific examples of the computer readable medium may include but are not limited to a portable computer diskette, a hard disk, a random access memory (RAM), a read-only memory (ROM), an erasable programmable read-only memory (EPROM or Flash memory), a portable compact disc read-only memory (CD-ROM), a digital versatile disc (DVD), an optical storage device, a magnetic storage device, a holographic storage medium, a micromechanical storage device, or any suitable combination of the foregoing. In the context of this document, a computer readable storage medium may be any tangible medium that can contain, and/or store computer readable program code for use by and/or in connection with an instruction execution system, apparatus, or device.

The computer readable medium may also be a computer readable signal medium. A computer readable signal medium may include a propagated data signal with computer readable program code embodied therein, for example, in baseband or as part of a carrier wave. Such a propagated signal may take any of a variety of forms, including, but not limited to, electrical, electro-magnetic, magnetic, optical, or any suitable combination thereof. A computer readable signal medium may be any computer readable medium that is not a computer readable storage medium and that can communicate, propagate, or transport computer readable program code for use by or in connection with an instruction execution system, apparatus, or device. Computer readable program code embodied on a computer readable signal medium may be transmitted using any appropriate medium, including but not limited to wireless, wireline, optical fiber cable, Radio Frequency (RF), or the like, or any suitable combination of the foregoing In one embodiment, the computer readable medium may comprise a combination of one or more computer readable storage mediums and one or more computer readable signal mediums. For example, computer readable program code may be both propagated as an electro-magnetic signal through a fiber optic cable for execution by a processor and stored on RAM storage device for execution by the processor.

Computer readable program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The computer readable program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

The present subject matter may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus for controlling combustion in an internal combustion engine having a fuel delivery system, comprising:

a cylinder contents prediction module configured to predict at least one condition within a combustion cylinder of the internal combustion engine;

a fuel state module configured to select a fuel control state of the internal combustion engine based on an engine control state of the internal combustion engine, wherein the fuel control state is only one of a nominal fuel control state and a temperature management fuel control state, wherein the temperature management fuel control state is selected when an elevated exhaust gas temperature is desired; and a fueling parameter selection module configured to:

determine a nominal fuel parameter associated with the nominal fuel control state and a peak fuel parameter associated with the temperature management fuel control state, wherein each of the nominal and peak fuel parameters are determined based on an operating condition of the internal combustion engine and the predicted at least one condition within the combustion cylinder;

determine a nominal exhaust gas temperature using the nominal fuel parameter and a peak exhaust gas temperature using the peak fuel parameter;

determine a temperature weight factor based on a desired exhaust gas temperature, the nominal exhaust gas temperature, and the peak exhaust gas temperature, wherein the desired exhaust gas temperature is based on a desired operating condition of the internal combustion engine;

determine a desired fuel parameter based on the temperature weight factor, the nominal fuel parameter, and the peak fuel parameter; and generate a fuel command for controlling a fueling operation for the internal combustion engine by the fuel delivery system based on the desired fuel parameter;

wherein in the nominal fuel control state, the desired exhaust gas temperature is equal to the nominal exhaust gas temperature such that the temperature weight factor is equal to zero, and wherein in the temperature management fuel control state, the desired exhaust gas temperature differs from the nominal exhaust gas temperature such that the temperature weight factor is a non-zero value.

2. The apparatus of claim 1, wherein the internal combustion engine comprises an air path system, the apparatus further comprising a system properties control module configured to determine at least one air path performance target based on a specific speed and torque of the engine, the system properties control module further configured to determine a total fuel mass to be added to the engine based on the specific speed and torque of the engine, wherein the fuel command is based at least partially on the determined total fuel mass.

3. The apparatus of claim 2, wherein the fueling parameter selection module comprises a fuel table module comprising at least one nominal fueling table comprising the nominal fueling parameter compared against a combination of three engine operating condition values, and at least one peak fueling table comprising the peak fueling parameter compared against the same combination of three engine operating condition values, and wherein the fuel table module determines at least one nominal fueling parameter from the at least one nominal fueling table based on current values for the three engine operating conditions and determines at least one peak fueling parameter from the at least one peak fueling table based on current values for the three engine operating conditions, wherein the fuel command is based on at least one of the determined nominal and peak fueling parameters.

4. The apparatus of claim 3, wherein the three engine operating conditions comprise the predicted at least one condition within the combustion cylinder, the total fueling mass, and the engine speed.

5. The apparatus of claim 4, wherein the predicted at least one condition within the combustion cylinder comprises a predicted oxygen concentration within the combustion cylinder.

6. The apparatus of claim 1, wherein the engine control state comprises one of more than two possible engine control states.

7. The apparatus of claim 1, wherein the fuel command is based on fueling parameters obtained from a set of look-up tables associated with the fuel control state of the engine, wherein the set of look-up tables consists of one set of look-up tables associated with the nominal fuel control state and another set of look-up tables associated with the temperature management fuel control state.

8. The apparatus of claim 1, wherein the internal combustion engine comprises an air path system, the apparatus further comprising a system properties control module configured to determine at least one air path performance target based on a specific speed and torque of the engine, and wherein the fuel command is based at least partially on the specific speed and torque of the engine and the predicted at least one condition within the combustion cylinder comprises a prediction of at least one condition within the combustion cylinder resulting from a combustion event governed by the at least one air path performance target.

9. The apparatus of claim 1, wherein the internal combustion engine comprises an air path system, and wherein the predicted at least one condition within the combustion cylinder is based on a prediction of the actual performance of the air path system.

10. A method for controlling combustion in an internal combustion engine, comprising:

determining, by a controller, air path targets based on operating conditions of the internal combustion engine;

commanding, by the controller, an air path system of the internal combustion engine based on the determined air path targets;

selecting, by the controller, a fuel control state of the internal combustion engine based on an engine control state of the internal combustion engine, wherein the fuel control state is only one of a nominal fuel control state and a temperature management fuel control state, wherein the temperature management fuel control state is selected when an elevated exhaust gas temperature is desired;

determining, by the controller, a nominal fuel parameter associated with the nominal fuel control state and a peak fuel parameter associated with the temperature management control state, wherein each of the nominal and peak fuel parameters are determined based on an operating condition of the internal combustion engine and a prediction of the actual performance of the air path system when actuated according to the determined air path targets;

determining, by the controller, a nominal exhaust gas temperature using the nominal fuel parameter and a peak exhaust gas temperature using the peak fuel parameter;

determining, by the controller, a temperature weight factor based on a desired exhaust gas temperature, the nominal exhaust gas temperature, and the peak exhaust gas temperature, wherein the desired exhaust gas temperature is based on a desired operating condition of the internal combustion engine;

determining, by the controller, a desired fuel parameter based on the temperature weight factor, the nominal fuel parameter, and the peak fuel parameter; and commanding, by the controller, a fuel delivery system of the internal combustion engine based on the desired fuel parameter;

wherein in the nominal fuel control state, the desired exhaust gas temperature is equal to the nominal exhaust gas temperature such that the temperature weight factor is equal to zero, and wherein in the temperature management fuel control state, the desired exhaust gas temperature differs from the nominal exhaust gas temperature such that the temperature weight factor is a non-zero value.

11. The method of claim 10, wherein the prediction of the actual performance of the air path system comprises a prediction of at least one condition within a combustion cylinder of the internal combustion engine.

12. The method of claim 10, wherein the nominal fuel parameter is obtained from a nominal fuel look-up table and the peak fuel parameter is obtained from a peak fuel look-up table.

13. The method of claim 10, wherein the air path targets are determined based on one of a plurality of air path table sets each associated with a plurality of engine control states.

14. The method of claim 13, wherein the nominal and temperature management fuel control states are condensed representations of the plurality of engine control states.

15. An internal combustion engine system, comprising:

an internal combustion engine comprising combustion cylinders:

an air path system coupled to the internal combustion engine, the air path system configured to supply air to the combustion cylinders according to air path commands;

a fuel delivery system coupled to the internal combustion engine, the fuel delivery system configured to supply fuel to the combustion cylinders according to fueling commands; and a controller communicable with the air path system and fuel delivery system, and wherein the controller comprises:

a system properties control module configured to determine air path targets based on operating conditions of the internal combustion engine, the air path commands being based on the determined air path targets;

a cylinder contents prediction module configured to predict at least one condition within the combustion cylinders of the internal combustion engine;

a fuel state module configured to select a fuel control state of the internal combustion engine from only a nominal fuel control state and a temperature management fuel control state, wherein the temperature management fuel control state is selected when an elevated exhaust gas temperature is desired; and a fueling parameter selection module configured to:

determine fueling parameters based on the air path targets, the predicted at least one condition within the combustion cylinders, and the fuel control state, wherein the fueling parameters include a nominal fuel parameter associated with the nominal fuel control state and a peak fuel parameter associated with the peak fuel control state;

determine a nominal exhaust gas temperature using the nominal fuel parameter and a peak exhaust gas temperature using the peak fuel parameter;

determine a temperature weight factor based on a desired exhaust gas temperature, the nominal exhaust gas temperature, and the peak exhaust gas temperature, wherein the desired exhaust gas temperature is based on a desired operating condition of the internal combustion engine;

determine a desired fuel parameter based on the temperature weight factor, the nominal fuel parameter, and the peak fuel parameter; and generate the fuel commands for controlling a fueling operation for the internal combustion engine by the fuel delivery system based on the desired fuel parameter;

wherein in the nominal fuel control state, the desired exhaust gas temperature is equal to the nominal exhaust gas temperature such that the temperature weight factor is equal to zero, and wherein in the temperature management fuel control state, the desired exhaust gas temperature differs from the nominal exhaust gas temperature such that the temperature weight factor is a non-zero value.

* * * * *